US007686101B2

(12) United States Patent
Belew et al.

(10) Patent No.: US 7,686,101 B2
(45) Date of Patent: Mar. 30, 2010

(54) METHOD AND APPARATUS FOR LATERALLY DRILLING THROUGH A SUBTERRANEAN FORMATION

(76) Inventors: David Belew, 2314 S. County Road 1120, Midland, TX (US) 79706; Barry Belew, 1624 E. 51st St., Odessa, TX (US) 79762; Alice Belew, legal representative, 1624 E. 51st St., Odessa, TX (US) 79762

( * ) Notice: Subject to any disclaimer, the term of this patent is extended or adjusted under 35 U.S.C. 154(b) by 541 days.

(21) Appl. No.: 11/246,896

(22) Filed: Oct. 7, 2005

(65) Prior Publication Data

US 2008/0110629 A1 May 15, 2008

Related U.S. Application Data

(63) Continuation-in-part of application No. 11/109,502, filed on Apr. 19, 2005, now abandoned, which is a continuation of application No. 10/290,113, filed on Nov. 7, 2002, now Pat. No. 6,920,945.

(51) Int. Cl.
*E21B 7/08* (2006.01)
*E21B 7/18* (2006.01)

(52) U.S. Cl. ..... 175/62; 175/67; 175/79; 175/424

(58) Field of Classification Search ..... 175/61, 175/62, 67, 79, 81, 107, 424
See application file for complete search history.

(56) References Cited

U.S. PATENT DOCUMENTS

| | | | | |
|---|---|---|---|---|
| 2,441,881 | A * | 5/1948 | Hays | 91/49 |
| 4,007,797 | A | 2/1977 | Jeter | |
| 4,057,115 | A * | 11/1977 | Blanz | 173/160 |
| 4,175,626 | A | 11/1979 | Tummel | |
| 4,534,427 | A * | 8/1985 | Wang et al. | 175/67 |
| 5,944,456 | A * | 8/1999 | Shirley et al. | 407/42 |
| 6,125,949 | A * | 10/2000 | Landers | 175/62 |
| 6,220,372 | B1 * | 4/2001 | Cherry | 175/81 |
| 6,283,230 | B1 * | 9/2001 | Peters | 175/67 |
| 6,378,629 | B1 * | 4/2002 | Baird | 175/75 |
| 6,550,553 | B2 * | 4/2003 | Baird | 175/75 |
| 6,708,769 | B2 | 3/2004 | Haugen et al. | |
| 6,799,647 | B2 * | 10/2004 | Clemmons | 175/89 |
| 7,540,339 | B2 * | 6/2009 | Kolle | 175/67 |
| 2002/0005286 | A1 * | 1/2002 | Mazorow et al. | 166/255.3 |
| 2005/0109541 | A1 * | 5/2005 | Marvin et al. | 175/67 |
| 2006/0124362 | A1 * | 6/2006 | Kolle et al. | 175/67 |

* cited by examiner

*Primary Examiner*—David J Bagnell
*Assistant Examiner*—David Andrews
(74) *Attorney, Agent, or Firm*—Scheef & Stone, L.L.P.; Jack D. Stone, Jr.

(57) ABSTRACT

An internally rotating nozzle for facilitating drilling through a subterranean formation is rotatably mounted internally within a housing connected to a hose for receiving high pressure fluid. The rotor includes at least two tangential jets oriented off of center for ejecting fluid to generate torque and rotate the rotor and cut a substantially cylindrical tunnel in the subterranean formation.

48 Claims, 6 Drawing Sheets

METHOD AND APPARATUS FOR LATERALLY DRILLING THROUGH A SUBTERRANEAN FORMATION

CROSS-REFERENCES TO RELATED APPLICATIONS

This application is a continuation-in-part of U.S. patent application Ser. No. 11/109,502, entitled "METHOD AND SYSTEM FOR FACILITATING HORIZONTAL DRILLING", filed on Apr. 19, 2005 now abandoned, to Belew, et al., which is a continuation of application Ser. No. 10/290,113 now U.S. Pat. No. 6,920,945, entitled "METHOD AND SYSTEM FOR FACILITATING HORIZONTAL DRILLING", filed on Nov. 7, 2002 now U.S. Pat. No. 6,920,945, on behalf of Belew, et al., which aforementioned application and patent are hereby incorporated herein by reference, in their entirety.

TECHNICAL FIELD

The present invention relates generally to a method and system for facilitating horizontal (also referred to as "lateral") drilling into a subterranean formation surrounding a well casing. More particularly, the invention relates to an internally rotating nozzle that may be used to facilitate substantially horizontal drilling into a subterranean formation surrounding a well casing.

BACKGROUND

The rate at which hydrocarbons are produced from wellbores in subterranean formations is often limited by wellbore damage caused by drilling, cementing, stimulating, and producing. As a result, the hydrocarbon drainage area of wellbores is often limited, and hydrocarbon reserves become uneconomical to produce sooner than they would have otherwise, and are therefore not fully recovered. Similarly, increased power is required to inject fluids, such as water and $CO_2$, and to dispose of waste water, into wellbores when a wellbore is damaged.

Formations may be fractured to stimulate hydrocarbon production and drainage from wells, but fracturing is often difficult to control and results in further formation damage and/or breakthrough to other formations.

Tight formations are particularly susceptible to formation damage. To better control damage to tight formations, lateral (namely, horizontal) completion technology has been developed. For example, guided rotary drilling with a flexible drill string and a decoupled downhole guide mechanism has been used to drill laterally into a formation, to thereby stimulate hydrocarbon production and drainage. However, a significant limitation of this approach has been severe drag and wear on drill pipe since an entire drill string must be rotated as it moves through a curve going from vertical to horizontal drilling.

Coiled tubing drilling (CTD) has been used to drill lateral drainage holes, but is expensive and typically requires about a 60 to 70 foot radius to maneuver into a lateral orientation.

High pressure jet systems, utilizing non-rotating nozzles and externally rotating nozzles with fluid bearings have been developed to drill laterally to bore tunnels (also referred to as holes or boreholes) through subterranean formations. Such jet systems, however, have failed due to the turbulent dissipation of jets in a deep, fluid-filled borehole, due to the high pressure required to erode deep formations, and, with respect to externally rotating nozzles, due to impairment of the rotation of the nozzle from friction encountered in the formation.

Accordingly, there is a need for methods and systems by which wellbore damage may be minimized and/or bypassed, so that hydrocarbon drainage areas and drainage rates may be increased, and the power required to inject fluids and dispose of waste water into wellbores may be reduced.

BRIEF SUMMARY OF THE INVENTION

According to the present invention, lateral (i.e., horizontal) wellbores are utilized to facilitate a more efficient sweep in secondary and tertiary hydrocarbon recovery fields, and to reduce the power required to inject fluids and dispose of waste water into wells. The horizontal drilling of such lateral wellbores through a well casing is facilitated by positioning in the well casing a shoe defining a passageway extending from an upper opening in the shoe through the shoe to a side opening in the shoe. A rod and casing mill assembly is then inserted into the well casing and through the passageway in the shoe until a casing mill end of the casing mill assembly abuts the well casing. The rod and casing mill assembly are then rotated until the casing mill end forms a perforation in the well casing.

An internally rotating nozzle is rotatably mounted in a housing connectable to a hose for receiving high pressure fluid. The rotor includes at least two tangential jets oriented off of center and configured for ejecting fluid to generate torque and rotate the rotor.

The rotating nozzle is then attached to the end of a flexible hose which is extended through the passageway to the perforation. High pressure fluid is ejected from the rotating nozzle through the perforation to cut a tunnel in subterranean earth formation.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF THE PREFERRED EMBODIMENT

Figure 1:
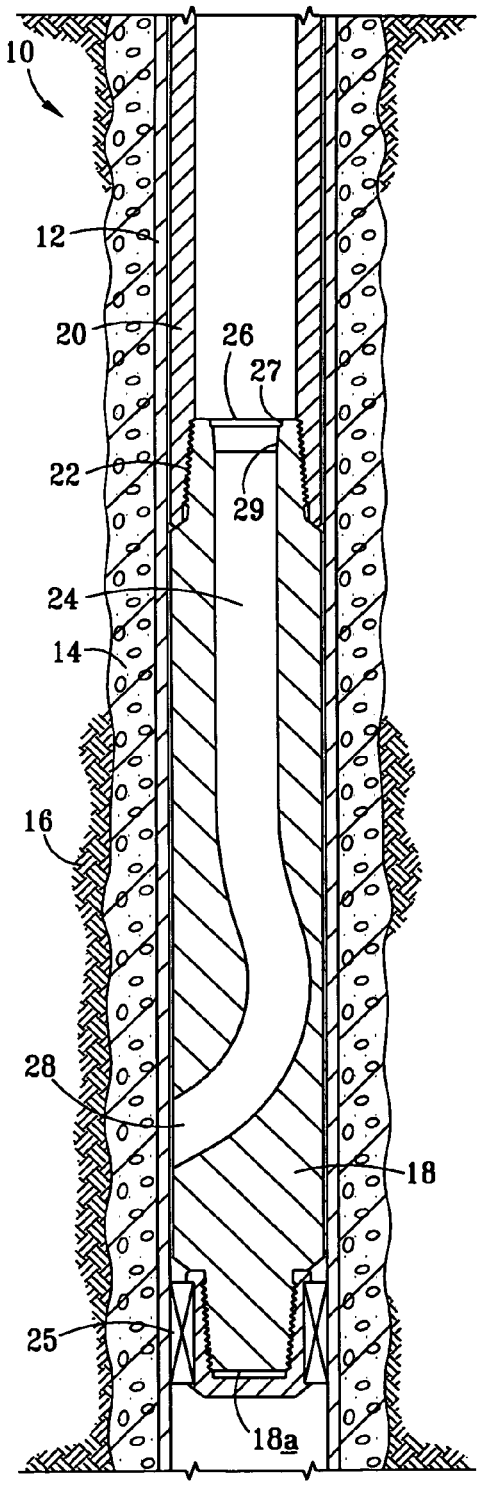
FIG. 1 is a cross-sectional elevation view of a well having a drilling shoe positioned therein.

In the discussion of the FIGURES the same reference numerals will be used throughout to refer to the same or similar components. In the interest of conciseness, various other components known to the art, such as wellheads, drilling components, motors, and the like necessary for the operation of the wells, have not been shown or discussed except insofar as necessary to describe the present invention.

Referring to FIG. 1 of the drawings, the reference numeral 10 generally designates an existing well encased by a well casing 12 and cement 14. The well 10 passes through a subterranean formation 16 from which petroleum is drawn. A drilling shoe 18 is securely attached to a tubing 20 via a tapered threaded fitting 22 formed between the tubing 20 and the shoe 18. The shoe 18 and tubing 20 are defined by an outside diameter approximately equal to the inside diameter of the well casing 12 less sufficient margin to preclude jamming of the shoe 18 and tubing 20 as they are lowered through the casing 12. The shoe 18 further defines a passageway 24 which extends longitudinally through the shoe, and which includes an upper opening 26 and a lower opening 28. The passageway 24 defines a curved portion having a radius of preferably at least three inches. The upper opening 26 preferably includes a limit chamfer 27 and an angle guide chamfer 29, for receiving a casing mill, described below.

As shown in FIG. 1, the shoe 18 is lowered in the well 10 to a depth suitable for tapping into a hydrocarbon deposit (not shown), and is angularly oriented in the well 10 using well-known techniques so that the opening 28 of the shoe 18 is directed toward the hydrocarbon deposit. The shoe 18 is fixed in place by an anchoring device 25, such as a conventional packer positioned proximate to a lower end 18*a* of the shoe 18. While the anchoring device 25 is shown in FIG. 1 as positioned proximate to the lower end 18*a* of the show 18, the anchoring device is preferably positioned above, or alternatively, below the shoe.

Figure 2:
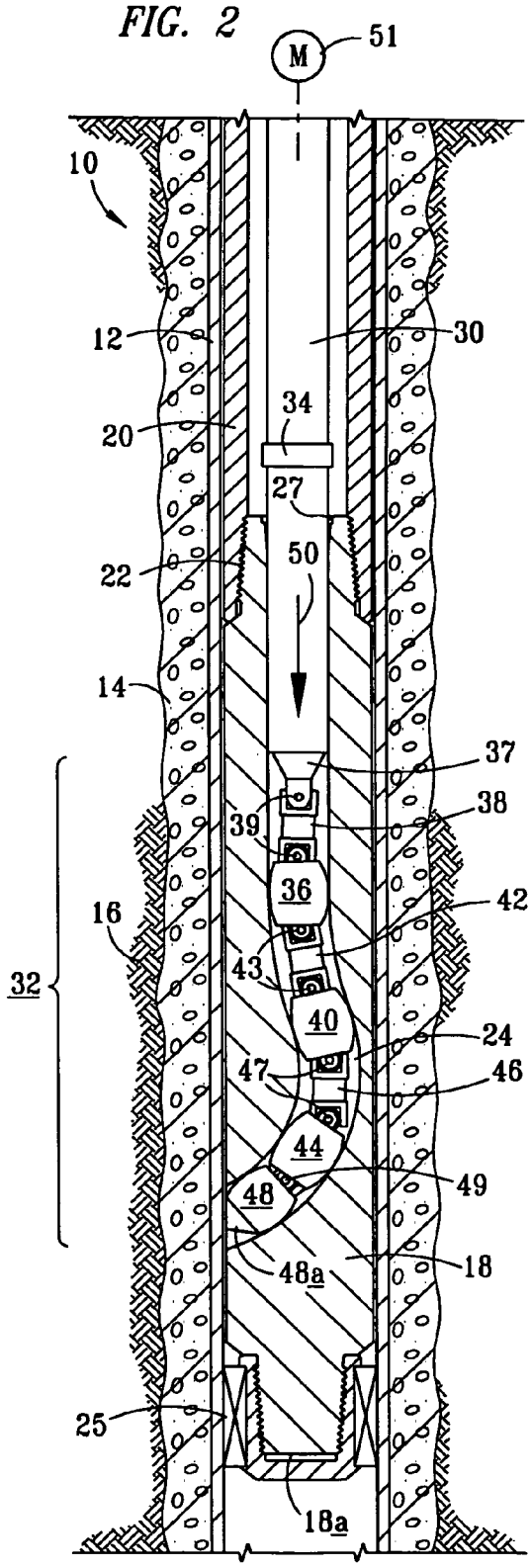
FIG. 2 is a cross-sectional elevation view of the well of FIG. 1 having a perforation mechanism embodying features of the present invention positioned within the drilling shoe.

FIG. 2 depicts the insertion of a rod 30 and casing mill assembly 32 as a single unit through the tubing 20 and into the passageway 24 of the shoe 18 for perforation of the well casing 12. The rod 30 preferably includes an annular collar 34 sized and positioned for seating in the chamfer 27 upon entry of the casing mill 32 in the cement 14, as described below with respect to FIG. 3. The rod 30 further preferably includes, threadingly connected at the lower end of the rod 30, a yoke adapter 37 connected to a substantially barrel-shaped (e.g., semi-spherical or semi-elliptical) yoke 36 via a substantially straight yoke 38 and two conventional block and pin assemblies 39 operative as universal joints. The barrel-shaped yoke 36 is connected to a similar substantially barrel-shaped yoke 40 via a substantially straight yoke 42 and two conventional block and pin assemblies 43 operative as universal joints. Similarly, the barrel-shaped yoke 40 is connected to a substantially barrel-shaped yoke 44 via a substantially straight yoke 46 and two conventional block and pin assemblies 47 operative as universal joints. Similarly, the barrel-shaped yoke 44 is connected to a substantially barrel-shaped "half" yoke 48 via a conventional block and pin assembly 49 operative as a universal joint. The surfaces of the yokes 36, 40, 44, and 48 are preferably barrel-shaped so that they may be axially rotated as they are passed through the passageway 24 of the shoe 18. The yoke 48 includes a casing mill end 48*a* preferably having, for example, a single large triangular-shaped cutting tooth (shown), a plurality of cutting teeth, or the like, effective upon axial rotation for milling through the well casing 12 and into the cement 14. The milling end 48*a* is preferably fabricated from a hardened, high strength, stainless steel, such as 17-4 stainless steel with tungsten carbides inserts, tungsten carbide, or the like, having a relatively high tensile strength of, for example, at least 100,000 pounds per square inch, and, preferably, at least 150,000 pounds per square inch. While four substantially barrel-shaped yokes 36, 40, 44, and 48, and three substantially straight yokes 38, 42, 46, are shown and described with respect to FIG. 2, more or fewer yokes may be used to constitute the casing mill assembly 32.

The rod 30 is preferably connected at the well-head of the well 10 to a rotating device, such as a motor 51, effective for generating and transmitting torque to the rod 30 to thereby impart rotation to the rod. The torque transmitted to the rod 30 is, by way of example, from about 25 to about 1000 foot-pounds of torque and, typically, from about 100 to about 500 foot-pounds of torque and, preferably, is about 200 to about 400 foot-pounds of torque. The casing mill assembly 32 is preferably effective for transmitting the torque and rotation from the rod 30 through the passageway 24 to the casing mill end 48.

In operation, the tubing 20 and shoe 18 are lowered into the well casing 12 and secured in position by an anchoring device 25, as described above. The rod 30 and casing mill assembly 32 are then preferably lowered as a single unit through the tubing 20 and guided via the angle guide chamfer 29 into the shoe 18. The motor 51 is then coupled at the well-head to the rod 30 for generating and transmitting preferably from about 100 to about 400 foot-pounds of torque to the rod 30, causing the rod 30 to rotate. As the rod 30 rotates, it imparts torque and rotation to and through the casing mill assembly 32 to rotate the casing mill end 48.

Figure 3:
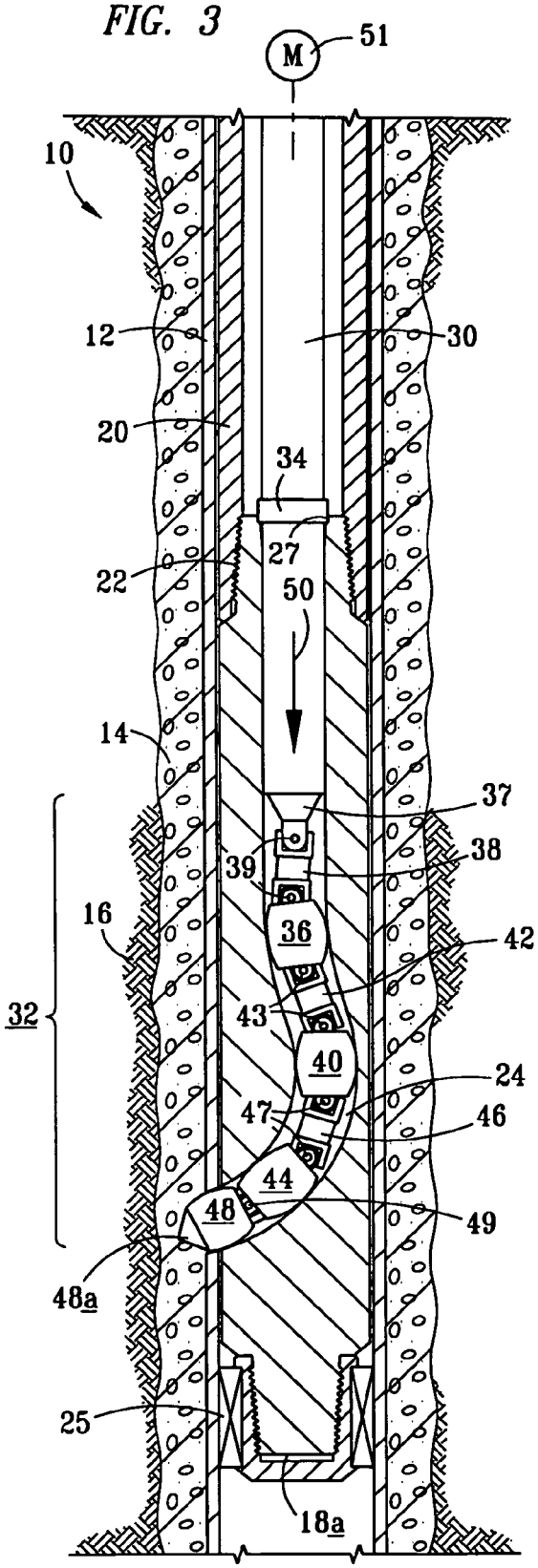
FIG. 3 is a cross-sectional elevation view of the well of FIG. 2 showing the well casing perforated by the perforation mechanism.

The weight of the rod 30 also exerts downward axial force in the direction of the arrow 50, and the axial force is transmitted through the casing mill assembly 32 to the casing mill end 48. The amount of weight transmitted through the casing mill assembly 32 to the casing mill end 48 may optionally be more carefully controlled to maintain substantially constant weight on the casing mill end 48 by using weight bars and bumper subs (not shown). As axial force is applied to move the casing mill end 48 into the well casing 12 and cement 14, and torque is applied to rotate the casing mill end 48, the well casing 12 is perforated, and the cement 14 is penetrated, as depicted in FIG. 3. The weight bars are thus suitably sized for efficiently perforating the well casing 12 and penetrating the cement 14 and, to that end, may, by way of example, be sized at 150 pounds each, it being understood that other weights may be preferable depending on the well. Weight bars and bumper subs, and the sizing thereof, are considered to be well known in the art and, therefore, will not be discussed in further detail herein.

Figure 4:
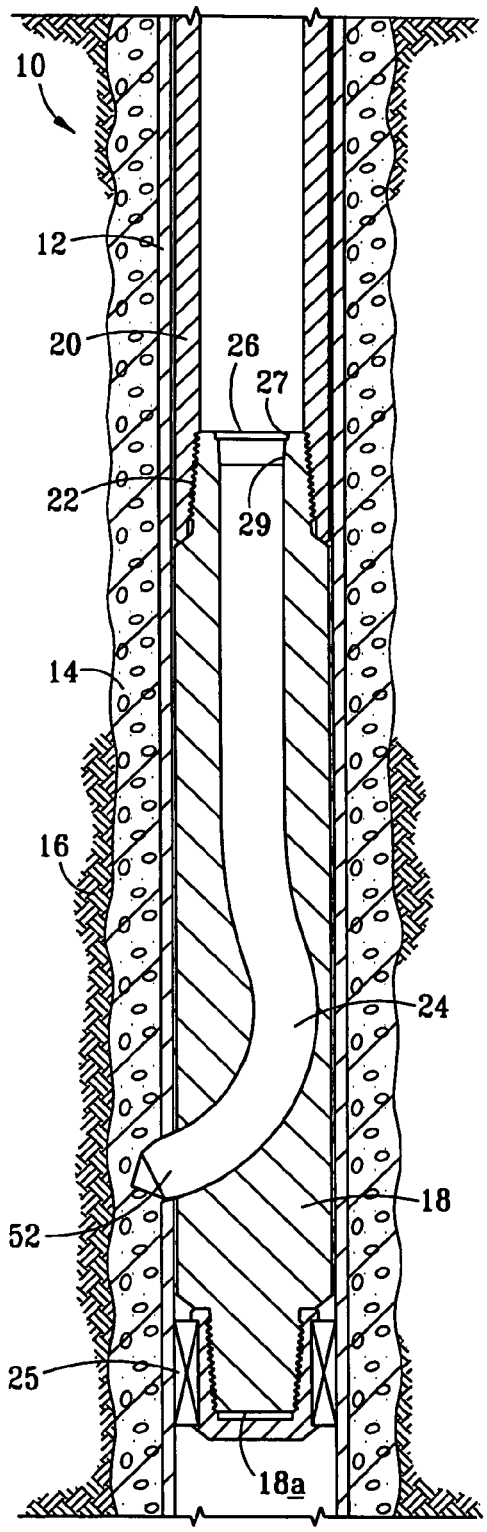
FIG. 4 is a cross-sectional elevation view of the well of FIG. 3 with the perforation mechanism removed.

As the casing mill end 48 penetrates the cement 14, the collar 34 seats in the chamfer 27, and the perforation of the well casing is terminated. The rod 30 and casing mill assembly 32 are then withdrawn from the shoe 18, leaving a perforation 52, which remains in the well casing 12, as depicted in FIG. 4. Notably, the cement 14 is preferably not completely penetrated. To obtain fluid communication with the petroleum reservoir/deposit of interest, a horizontal extension of the perforation 52 is used, as discussed below with respect to FIG. 5.

Figure 5:
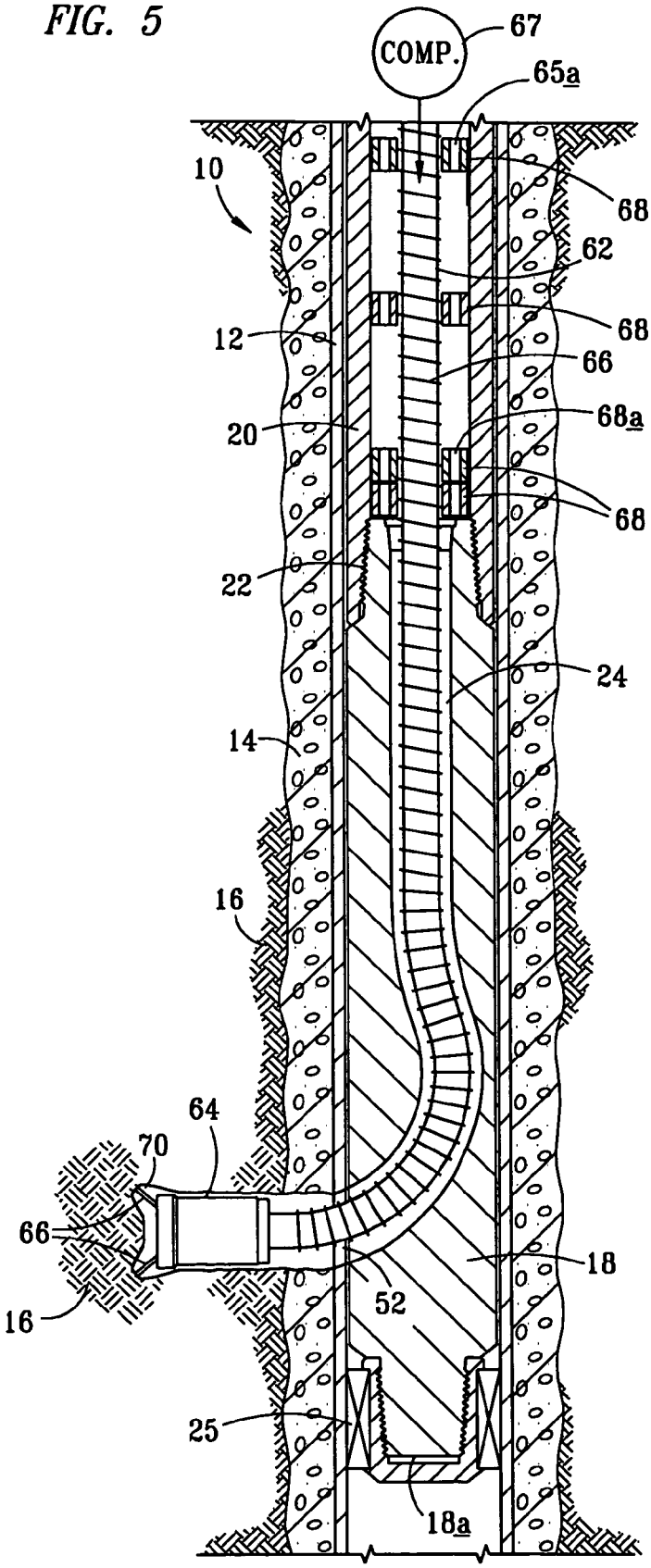
FIG. 5 is a cross-sectional elevation view of the well of FIG. 4 showing a hydraulic drilling device extended through the casing of the well.

FIG. 5 depicts a horizontal extension technique that may be implemented for extending the perforation 52 (FIG. 4) laterally into the formation 16 in accordance with present invention. The shoe 18 and tubing 20 are maintained in place. A flexible hose 62, having a nozzle 64 affixed to a lower end thereof, is extended through the tubing 20, the guide chamfer 29 and passageway 24 of the shoe 18, and the perforation 52 into the cement 14. The flexible hose 62 is preferably a high-pressure (e.g., tested for a capacity of 20,000 PSI or more) flexible hose, such as a Polymide 2400 Series hose, preferably capable of passing through a curve having a radius of three inches. The hose 62 is preferably circumscribed by a spring 66 preferably comprising spiral wire having a square cross-section (FIGS. 6, 8, and 10) which abuts the nozzle 64 for facilitating "pushing" the hose 62 downwardly through the tubing 20. The spring 66 may alternatively comprise spiral wire having a round cross-section. The nozzle 64 is a high-pressure rotating nozzle, as described in further detail with respect to FIGS. 6-10. A plurality of annular guides, referred to herein as centralizers, 68 are preferably positioned about the spring 66 and suitably spaced apart for inhibiting bending and kiniking of the hose 62 within the tubing 20. Each centralizer 68 has a diameter that is substantially equal to or less than the inside diameter of the tubing 20, and preferably also defines a plurality of slots and/or holes 68*a* for facilitating the flow of fluid through the tubing 20. The centralizers 68 are preferably also configured to slide along the spring 66 and rest and accumulate at the top of the shoe 18 as the hose 62 is pushed through the passageway 24 and perforation 52 into the formation 16.

Drilling fluid is then pumped at high pressure through the hose 62 to the nozzle 64 using conventional equipment 67 (e.g., a compressor, a pump, and/or the like) at the surface of the well 10. The drilling fluid used may be any of a number of different fluids effective for eroding subterranean formation, such fluids comprising liquids, solids, and/or gases including, by way of example but not limitation, one or a mixture of two or more of fresh water, produced water, polymers, water with silica polymer additives, surfactants, carbon dioxide, gas, light oil, methane, methanol, diesel, nitrogen, acid, and the like, which fluids may be volatile or non-volatile, compressible or non-compressible, and/or optionally may be utilized at supercritical temperatures and pressures. The drilling fluid is preferably injected through the hose 62 and ejected from the nozzle 64, as indicated schematically by the arrows 66, to impinge subterranean formation material. The drilling fluid loosens, dissolves, and erodes portions of the earth's subterranean formation 16 around the nozzle 64. The excess drilling fluid flows into and up the well casing 12 and tubing 20, and may be continually pumped away and stored. As the earth 16 is eroded away from the frontal proximity of the nozzle 64, a tunnel (also referred to as an opening or hole) 70 is created, and the hose 62 is extended into the tunnel. The tunnel 70 may generally be extended laterally 200 feet or more to insure that a passageway extends and facilitates fluid communication between the well 10 and the desired petroleum formation in the earth's formation 16.

After a sufficient tunnel 70 has been created, additional tunnels may optionally be created, fanning out in different directions at substantially the same level as the tunnel 70 and/or different levels. If no additional tunnels need to be created, then the flexible hose 62 is withdrawn upwardly from the shoe 18 and tubing 20. The tubing 20 is then pulled upwardly from the well 10 and, with it, the shoe 18. Excess drilling fluid is then pumped from the well 10, after which petroleum product may be pumped from the formation.

Figure 6:
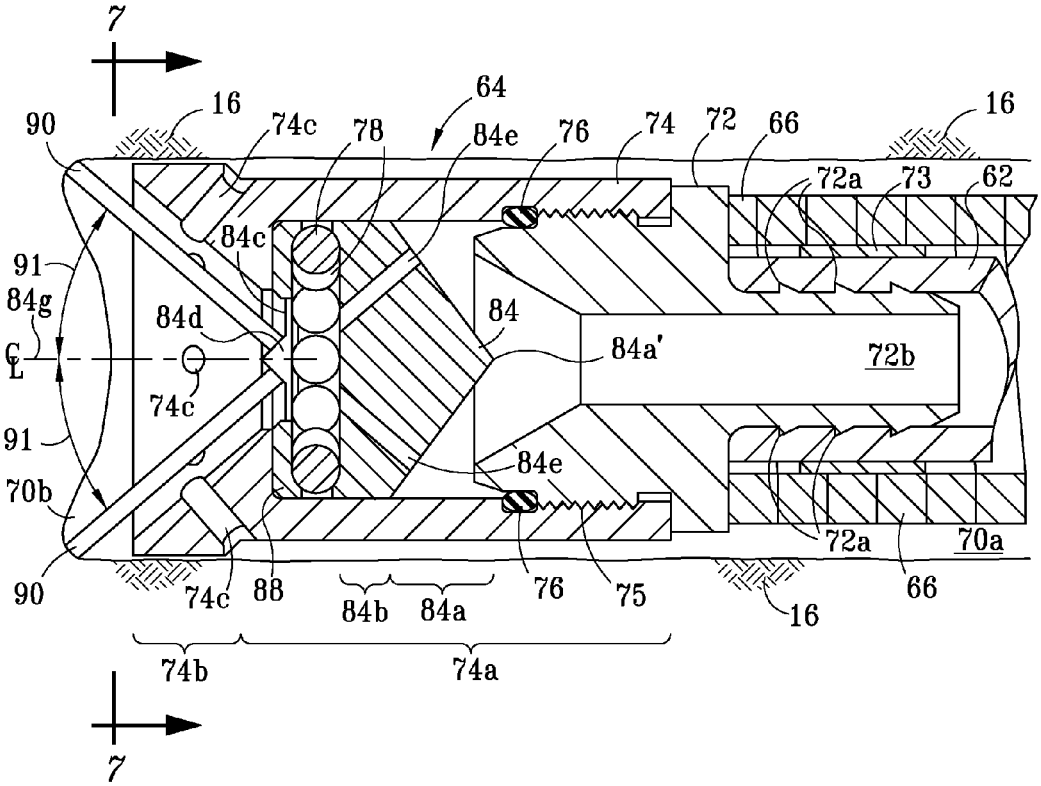
FIG. 6 is a cross-sectional elevation view of the nozzle of FIG. 5.

FIG. 6 depicts one preferred embodiment of the nozzle 64 in greater detail positioned in the tunnel 70, the tunnel having an aft portion 70*a* and a fore portion 70*b*. As shown therein, the nozzle 64 includes a hose fitting 72 configured for being received by the hose 62. In a preferred embodiment, the hose fitting 72 also includes circumferential barbs 72*a* and a conventional band 73 clamped about the periphery of the hose 62 for securing the hose 62 onto the hose fitting 72 and barbs 72*a*.

The hose fitting 72 is threadingly secured to a housing 74 of the nozzle 64 via threads 75, and defines a passageway 72*b* for providing fluid communication between the hose 62 and the interior of the housing 74. A seal 76, such as an O-ring seal, is positioned between the hose fitting 72 and the housing 74 to secure the housing 74 against leakage of fluid received from the hose 62 via the hose fitting 72. The housing 74 is preferably fabricated from a stainless steel, and preferably includes a first section 74*a* having a first diameter, and a second section 74*b* having a second diameter of about 2-20% larger than the first diameter, and preferably about 10% larger than the first diameter. While the actual first and second diameters of the housing 74 are scalable, by way of example and not limitation, in one preferred embodiment, the second diameter is about 1-1.5 inches in diameter, and preferably about 1.2 inches in diameter. About eight drain holes 74*c* are preferably defined between the first and second sections 74*a* and 74*b* of the housing 74, for facilitating fluid communication between the aft portion 70*a* and the fore portion 70*b* of the tunnel 70. The number of drain holes 74*c* may vary from eight, and accordingly may be more or less than eight drain holes.

A rotor 84 is rotatably mounted within the interior of the housing 74, and includes a substantially conical portion 84*a* and a cylindrical portion 84*b*. The conical portion 84*a* includes a vertex 84*a*' directed toward the hose fitting 72. The cylindrical portion 84*b* includes an outside diameter approximately equal to the inside diameter of the housing 74 less a margin sufficient to avoid any substantial friction between the rotor 84 and the housing 74. The cylindrical portion 84*b* abuts a bearing 78, preferably configured as a thrust bearing, and race 88, which seat against an end of the housing 74 opposed to the hose fitting 72. The thrust bearing 78 is preferably a carbide ball bearing, and the race 88 is preferably fabricated from carbide as well. A radial clearance seal (not shown) may optionally be positioned between the rotor 84 and the bearing race 88 to minimize fluid leakage through the bearing 78. A center extension portion 84*c* of the rotor 84 extends from the cylindrical portion 84*b* through the thrust bearings 78 and race 88, and two tangential jets 84*d* are formed on the rotor center extension portion 84*c*. Each jet 84*d* is configured to generate a jet stream having a diameter of about 0.025 to 0.075 inches, and preferably about 0.050". Passageways 84*e* are defined in the rotor 84 for facilitating fluid communication between the interior of the housing 74 and the jets 84*d*.

Figure 7:
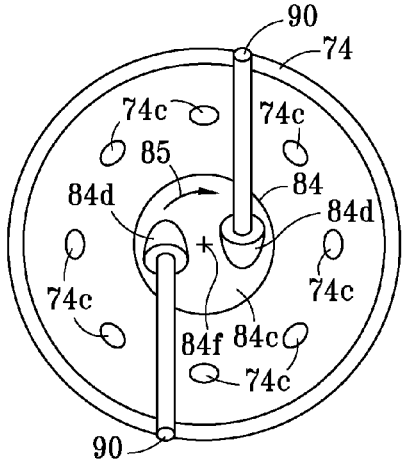
FIG. 7 is a elevation view taken along the line 7-7 of FIG. 6.

As shown most clearly in FIG. 7, the tangential jets 84*d* are offset from a center point 84*f* and are directed in substantially opposing directions, radially spaced from, and tangential to, the center point 84*f*. Referring back to FIG. 6, the jets 84*d* are preferably further directed at an angle 91 of about 45° from a centerline 84*g* extending through the rotor 84 from the vertex 84*a* through the center point 84*f*.

Further to the operation described above with respect to FIGS. 1-5, and with reference to FIGS. 6 and 7, fluid is pumped down and through the hose 62 at a flow rate of about 15 to 25 gallons per minute (GPM), preferably about 20 GPM, and a pressure of about 10,000 to 20,000 pounds per square inch (PSI), preferably about 15,000 PSI. The fluid passes through the passageway 72*b* into the interior of the housing 74. The fluid then passes into and through the passageways 84*e* to the jets 84*d*, and is ejected as a coherent jet stream of fluid 90 from the jets 84*c* at an angle 91 from the centerline 84*g*. The jet stream of fluid 90 impinges and erodes earth in the fore portion 70*b* of the tunnel 70. A tangential component of the stream of fluid 90 (FIG. 7) causes the rotor 84 to rotate in the direction of an arrow 85 at a speed of about 40,000 to 60,000 revolutions per minute (RPM), though a lower RPM are generally preferred, as discussed in further detail below with respect to FIGS. 8-11. As the rotor 84 rotates, the stream of fluid 90 rotates, further impinging and eroding a cylindrical portion of earth in the fore portion 70*b* of the tunnel 70, thereby extending longitudinally the tunnel 70. As earth is eroded, it mixes with the fluid, drains away through the holes 74*c*, passes through the aft portion 70*a* of the tunnel 70, and then flows upwardly through and out of the well 10. The nozzle 64 is then urged via the hose 62 toward the fore portion 70*b* of the tunnel 70 to extend the tunnel 70 as a substantially horizontal portion of the well 10.

Figure 8:
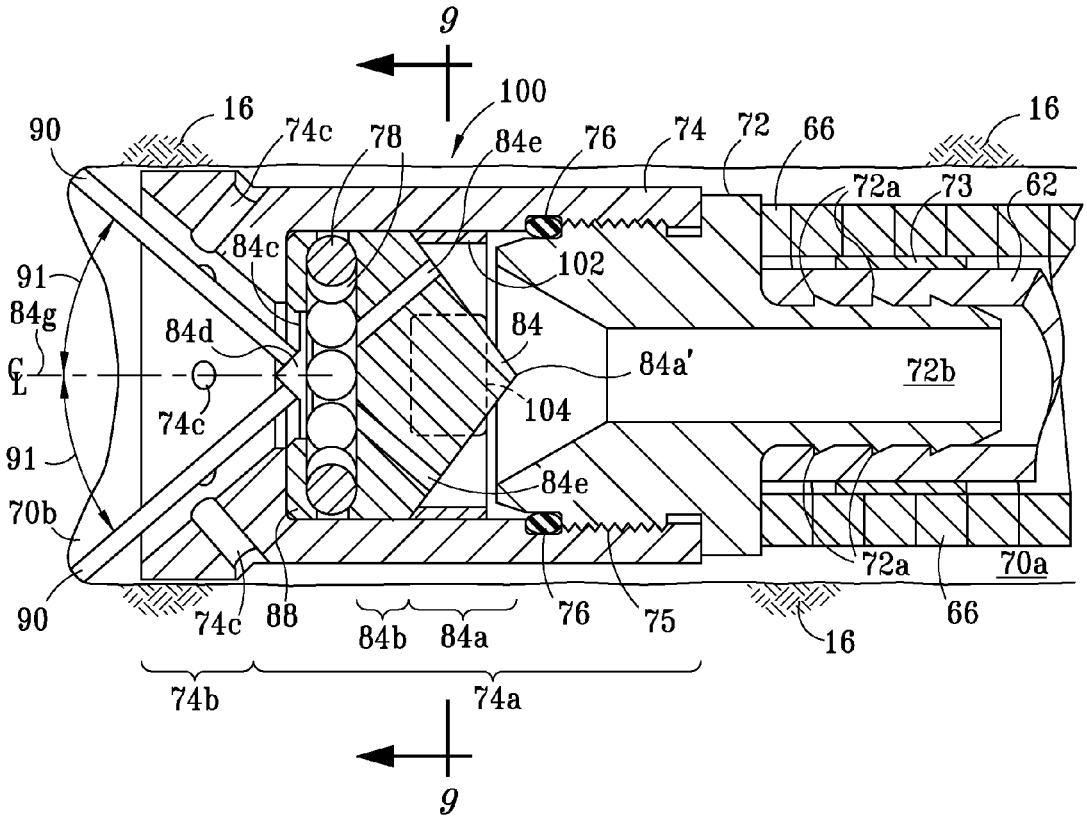
FIG. 8 is a cross-sectional elevation view of an alternative embodiment of the nozzle of FIG. 6 with brakes.
Figure 9:
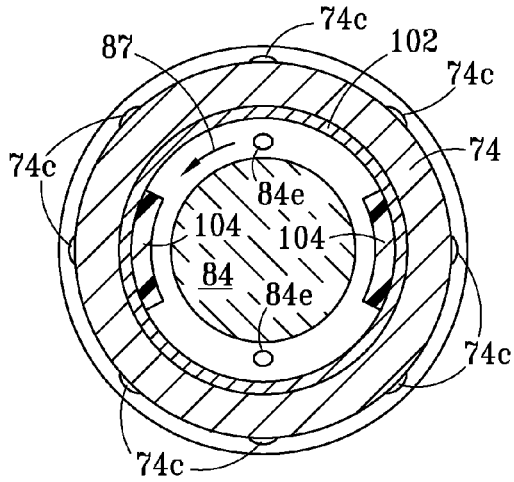
FIG. 9 is a cross-sectional elevation view taken along the line 9-9 of FIG. 8.
Figure 11:
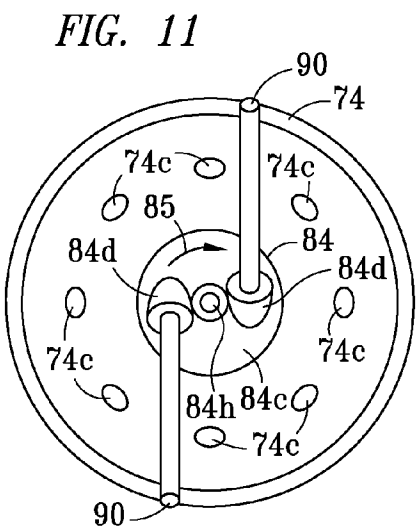
FIG. 11 is a elevation view taken along the line 11-11 of FIG. 10.

FIGS. 8 and 9 depict the details of a nozzle 100 according to an alternate embodiment of the present invention. Since the nozzle 100 contains many components that are identical to those of the previous embodiment (FIGS. 6-7), these components are referred to by the same reference numerals, and will not be described in any further detail. According to the embodiment of FIGS. 8 and 9, a brake lining 102 extends along, and is substantially affixed to, the interior peripheral surface of the housing 74. The brake lining 102 is preferably fabricated from a relatively hard material, such as hardened carbide steel. Two or more brake pads 104, likewise fabricated from a relatively hard material, such as hardened carbide steel, are positioned within mating pockets defined between the rotor 84 and the brake lining 102, wherein the pockets are sized for matingly retaining the brake pads 104 proximate to the brake lining 102 so that, in response to centrifugal force, the brake pads 104 are urged and moved radially outwardly to frictionally engage the brake lining 102 as the rotor 64 rotates.

Operation of the nozzle 100 is similar to the operation of the nozzle 64, but for a braking effect imparted by the brake lining 102 and brake pads 104. More specifically, as the rotor 84 rotates, centrifugal force is generated which is applied onto the brake pads 104, urging and pushing the brake pads 104 outwardly until they frictionally engage the brake lining 102. It should be appreciated that as the rotor 84 rotates at an increasing speed, or RPM, the centrifugal force exerted on the brake pads 104 increases in proportion to the square of the RPM, and resistance to the rotation thus increases exponentially, thereby limiting the maximum speed of the rotor 84, without significantly impeding rotation at lower RPM's. Accordingly, in a preferred embodiment, the maximum speed of the rotor will be limited to the range of about 1,000 RPM to about 50,000 RPM, and preferably closer to 1,000 RPM (or even lower) than to 50,000 RPM. It is understood that the centrifugal force generated is, more specifically, a function of the product of the RPM squared, the mass of the brake pads, and radial distance of the brake pads from the centerline 84*g*. The braking effect that the brake pads 104 exert on the brake lining 102 is a function of the centrifugal force and the friction between the brake pads 104 and the brake lining 102, and, furthermore, is considered to be well known in the art and, therefore, will not be discussed in further detail herein.

Figure 10:
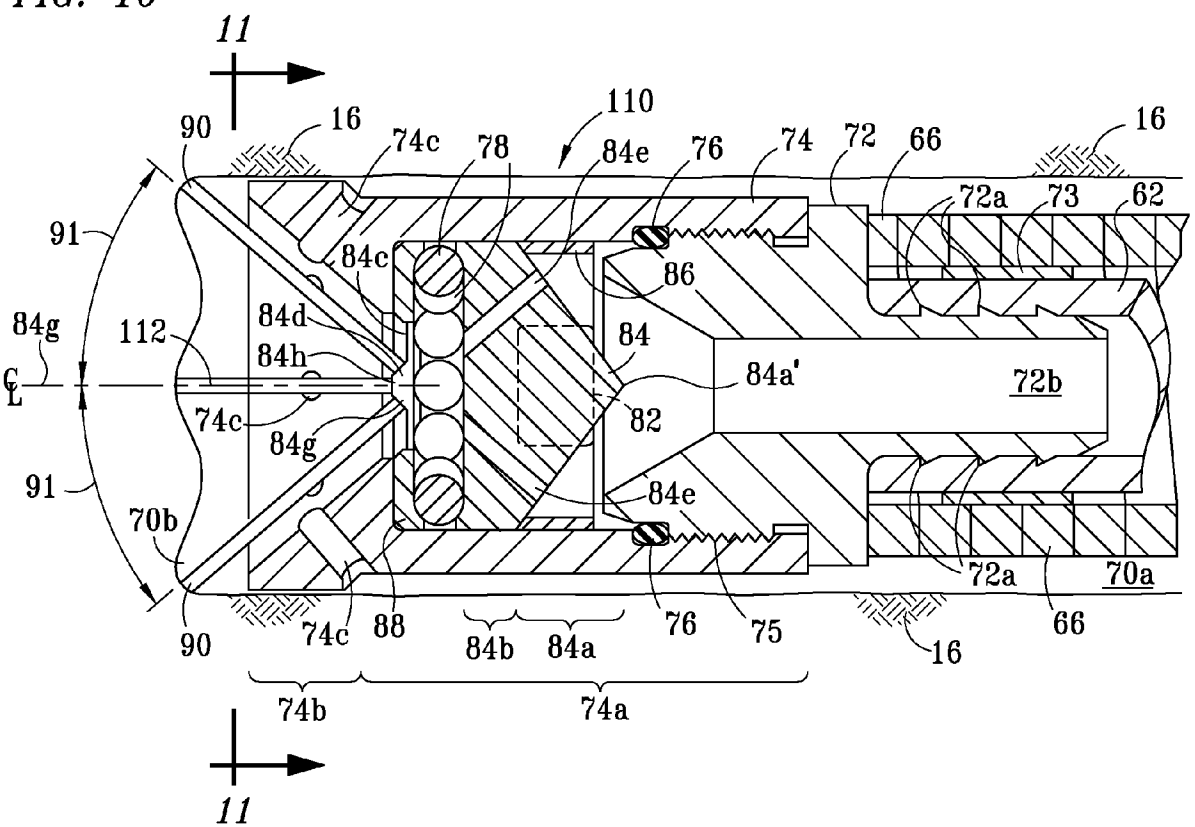
FIG. 10 is a cross-sectional elevation view of an alternative embodiment of the nozzle of FIG. 8 that further includes a center nozzle.

FIG. 10 depicts the details of a nozzle 110 according to an alternate embodiment of the present invention. Since the nozzle 110 contains many components that are identical to those of the previous embodiments (FIGS. 6-9), these components are referred to by the same reference numerals, and will not be described in any further detail. According to the embodiment of FIG. 10, and with reference also to FIG. 11, an additional center jet 84*h*, preferably smaller than (e.g., half the diameter of) the tangential jets 84*d*, is configured in the center extension portion 84*c* of the rotor 84, interposed between the two tangential jets 84*d* for ejecting a jet stream 112 of fluid along the centerline 84*g*.

Operation of the nozzle 110 is similar to the operation of the nozzle 100, but for providing an additional jet stream of fluid from the center jet 84*h*, effective for cutting the center of the tunnel 70.

By the use of the present invention, a tunnel may be cut in a subterranean formation in a shorter radius than is possible using conventional drilling techniques, such as a slim hole drilling system, a coiled tube drilling system, or a rotary guided short radius lateral drilling system. Even compared to ultra-short radius lateral drilling systems, namely, conventional water jet systems, the present invention generates a jet stream which is more coherent and effective for cutting a tunnel in a subterranean formation. Furthermore, by utilizing bearings, the present invention also has less pressure drop in the fluid than is possible using conventional water jet systems.

It is understood that the present invention may take many forms and embodiments. Accordingly, several variations may be made in the foregoing without departing from the spirit or the scope of the invention. For example, the conical portion 84*a* of the rotor 84, or a portion thereof, may be inverted to more efficiently capture fluid from the hose 62. The brake pads 104 (FIG. 9) may be tapered to reduce resistance from, and turbulence by, fluid in the interior of the housing 74 as the rotor 84 is rotated. The thrust bearing 78 may comprise types of bearings other than ball bearings, such as fluid bearings. Having thus described the present invention by reference to certain of its preferred embodiments, it is noted that the embodiments disclosed are illustrative rather than limiting in nature and that a wide range of variations, modifications, changes, and substitutions are contemplated in the foregoing disclosure and, in some instances, some features of the present invention may be employed without a corresponding use of the other features. Many such variations and modifications may be considered obvious and desirable by those skilled in the art based upon a review of the foregoing description of preferred embodiments. Accordingly, it is appropriate that the appended claims be construed broadly and in a manner consistent with the scope of the invention.

The invention claimed is:

1. An apparatus for laterally drilling through a subterranean formation, comprising:

a hose;

a housing coupled in fluid communication to said hose, said housing being configured for passing laterally through a wall of a well casing into a subterranean formation;

at least one spring circumscribing said hose along the entire length of said hose for facilitating pushing of said housing through said wall of said well casing and into said subterranean formation; and a rotor rotatably mounted within said housing, said rotor including at least one jet, said rotor further defining passageways for providing fluid communication between said interior of said housing and said at least one jet.

2. The apparatus of claim 1 further comprising at least one bearing mounted between said housing and said rotor for facilitating rotation of said rotor within said housing.

3. The apparatus of claim 1 further comprising at least one thrust bearing mounted between said housing and said rotor for facilitating rotation of said rotor within said housing.

4. The apparatus of claim 1 further comprising at least two brake pads mounted on said rotor proximate to said housing for frictionally engaging said housing from centrifugal force induced when said rotor is rotated.

5. The apparatus of claim 1 further comprising a brake lining positioned within said interior of said housing, and at least two brake pads mounted on said rotor proximate to said brake lining for frictionally engaging said brake lining from centrifugal force induced when said rotor is rotated.

6. The apparatus of claim 1 further comprising a carbide brake lining positioned within said interior of said housing, and at least two carbide brake pads mounted on said rotor proximate to said brake lining for frictionally engaging said brake lining from centrifugal force induced when said rotor is rotated.

7. The apparatus of claim 1 wherein said at least one jet includes at least two tangential jets oriented off center to generate torque to rotate said rotor, said rotor is configured to rotate about an axis, and said at least two tangential jets are directed at an angle skewed relative to said axis.

8. The apparatus of claim 1 wherein said at least one jet includes at least two tangential jets oriented off center to generate torque to rotate said rotor, and said rotor further comprises a center jet interposed between said at least two tangential jets.

9. The apparatus of claim 1, wherein said spring comprises a square cross-section.

10. A method for facilitating lateral drilling through a well casing, the method comprising the steps of:

positioning in the well casing a shoe defining a passageway extending from an upper opening in the shoe through the shoe to a side opening in the shoe;

inserting a rod and casing mill assembly into the well casing and through the passageway in the shoe until a casing mill end of the casing mill assembly substantially abuts the well casing;

rotating the rod and casing mill assembly until the casing mill end substantially forms a perforation in the well casing;

connecting a housing of an internally rotating nozzle to a first end of a hose circumscribed along the entire length of said hose by at least one spring, said hose having a second end in fluid communication with a source of pressurized fluid, said housing having a rotor rotatably mounted within said housing, said rotor defining passageways for providing fluid communication between said interior of said housing and at least one jet, said nozzle being configured for passing laterally through said perforation in the well casing into a subterranean formation;

pushing said internally rotating nozzle via said spring circumscribing said hose through the passageway and the perforation into the subterranean formation; and ejecting fluid from said at least one jet into the subterranean formation.

11. The method of claim 10 further comprising the step of mounting at least one bearing between said housing and said rotor for facilitating rotation of said rotor within said housing.

12. The method of claim 10 further comprising the step of mounting at least one thrust bearing between said housing and said rotor for facilitating rotation of said rotor within said housing.

13. The method of claim 10 further comprising the step of mounting at least two brake pads on said rotor proximate to said housing for frictionally engaging said housing from centrifugal force induced when said rotor is rotated.

14. The method of claim 10 further comprising the steps of positioning a brake lining within said interior of said housing, and mounting at least two brake pads on said rotor proximate to said brake lining for frictionally engaging said brake lining from centrifugal force induced when said rotor is rotated.

15. The method of claim 10 further comprising the steps of positioning a carbide brake lining within said interior of said housing, and mounting at least two carbide brake pads on said rotor proximate to said brake lining for frictionally engaging said brake lining from centrifugal force induced when said rotor is rotated.

16. The method of claim 10 wherein said at least one jet comprises at least two tangential jets oriented off center for generating torque to rotate said rotor responsive to said pressurized fluid, said rotor is configured to rotate about an axis, and said jets are directed at an angle skewed from said axis.

17. The method of claim 10 wherein said at least one jet comprises at least two tangential jets oriented off center for generating torque to rotate said rotor responsive to said pressurized fluid, and said rotor further comprises a center jet interposed between said at least two tangential jets.

18. The method of claim 10 wherein the casing mill assembly comprises at least one block and pin assembly coupled together to substantially form a universal joint connecting the rod to the casing mill end of the casing mill assembly for facilitating the step of inserting the casing mill assembly into and through the passageway of the shoe.

19. The method of claim 10 wherein the casing mill assembly comprises at least one yoke interconnecting at least two block and pin assemblies coupled together to substantially form at least two universal joints coupling together the rod and the casing mill end of the casing mill assembly for facilitating the step of inserting the casing mill assembly into and through the passageway of the shoe.

20. The method of claim 10 wherein the casing mill assembly comprises at least one barrel-shaped yoke interconnecting at least two block and pin assemblies coupled together to substantially form at least two universal joints coupling together the rod and the casing mill end of the casing mill assembly for facilitating the step of inserting the casing mill assembly into and through the passageway of the shoe.

21. The method of claim 10 wherein the upper end of the shoe includes a chamfer and the rod includes a collar configured for seating in the chamfer and positioned on the rod so that the casing mill end of the casing mill assembly is substantially precluded from movement extending through cement surrounding the well casing.

22. The method of claim 10 wherein the casing mill end comprises a milling portion fabricated from stainless steel with carbide inserts.

23. The method of claim 10 further comprising the steps of extending the nozzle through the perforation.

24. The method of claim 10 wherein said fluid further comprises surfactant.

25. The method of claim 10 wherein the step of ejecting further comprises the step of ejecting the fluid from the nozzle so that the fluid impinges subterranean formation material.

26. The method of claim 10 wherein the step of positioning further comprises attaching the shoe to tubing, and lowering the shoe into the well casing using the tubing.

27. The method of claim 10, wherein said spring comprises a square cross-section.

28. A method for facilitating lateral drilling through a perforation in a well casing, the method comprising the steps of:

positioning and anchoring in the well casing a shoe defining a passageway extending from an upper opening in the shoe through the shoe to a side opening in the shoe aligned with the perforation;

extending an internally rotating nozzle, having a housing connectable in fluid communication to the end of a hose in fluid communication with a source of pressurized fluid, through the passageway to the perforation, said housing having a rotor rotatably mounted within said housing, said rotor defining passageways for providing fluid communication between said interior of said housing and at least one jet, said nozzle being configured for passing laterally through the perforation into a subterranean formation, said hose being circumscribed along the entire length of said hose by at least one spring for facilitating pushing of said hose and said nozzle through the perforation;

ejecting fluid from said at least one jet; and extending said internally rotating nozzle through the perforation.

29. The method of claim 28, wherein said spring comprises a square cross-section.

30. A system for facilitating lateral drilling through a well casing, the system comprising:

a shoe positioned at a selected depth in the well casing, the shoe defining a passageway extending from an upper opening in the shoe through the shoe to a side opening in the shoe;

a rod connected to a casing mill assembly for insertion into and through the well casing and through the passageway in the shoe until a casing mill end of the casing mill assembly abuts the well casing;

a motor coupled to the rod for rotating the rod and casing mill assembly until the casing mill end forms a perforation in the well casing;

a hose having a first end and a second end, said first end of said hose being in fluid communication with a source of pressurized fluid;

an internally rotating nozzle having a housing in fluid communication with said second end of said hose; and at least one spring circumscribing said hose and extending from said nozzle at said second end of said hose to said first end of said hose for facilitating pushing of said hose and said nozzle through said perforation of said well casing into a subterranean formation.

31. The system of claim 30 wherein said motor is mounted at a wellhead.

32. The system of claim 30 wherein the casing mill assembly comprises at least one block and pin assembly coupled together to substantially form a universal joint interconnected between the rod and the casing mill end of the casing mill assembly.

33. The system of claim 30 wherein the casing mill assembly comprises at least one yoke interconnected between at least two block and pin assemblies coupled together to substantially form at least one first universal joint connected to the rod and at least one second universal joint connected to the casing mill end of the casing mill assembly.

34. The system of claim 30 wherein the casing mill assembly comprises at least one barrel-shaped yoke interconnected between at least two block and pin assemblies coupled together to substantially form at least one first universal joint connected to the rod and at least one second universal joint connected to the casing mill end of the casing mill assembly.

35. The system of claim 30 wherein the upper end of the shoe includes a chamfer and the rod includes a collar configured for seating in the chamfer and positioned on the rod so that the casing mill end of the casing mill assembly is substantially permitted to enter cement surrounding the well casing but precluded from passing through cement surrounding the well casing.

36. The system of claim 30 wherein the casing mill end comprises a milling portion fabricated from stainless steel with carbide inserts.

37. The system of claim 30 wherein said nozzle is positioned in the passageway such that the nozzle is effective for receiving from the hose fluid and for ejecting through the perforation the fluid into subterranean formation material.

38. The system of claim 30 wherein said rotating nozzle further comprises at least one bearing mounted between said housing and said rotor for facilitating rotation of said rotor within said housing.

39. The system of claim 30 wherein said rotating nozzle further comprises at least one thrust bearing mounted between said housing and said rotor for facilitating rotation of said rotor within said housing.

40. The system of claim 30 wherein said rotating nozzle further comprises at least two brake pads mounted on said rotor proximate to said housing for frictionally engaging said housing from centrifugal force induced when said rotor is rotated.

41. The system of claim 30 wherein said rotating nozzle further comprises a brake lining positioned within said interior of said housing, and at least two brake pads mounted on said rotor proximate to said brake lining for frictionally engaging said brake lining from centrifugal force induced when said rotor is rotated.

42. The system of claim 30 wherein said rotating nozzle further comprises a carbide brake lining positioned within said interior of said housing, and at least two carbide brake pads mounted on said rotor proximate to said brake lining for frictionally engaging said brake lining from centrifugal force induced when said rotor is rotated.

43. The system of claim 30 wherein said housing includes a rotor rotatably mounted within said housing, said rotor defining passageways for providing fluid communication between said interior of said housing and at least two tangential jets oriented off center for generating torque to rotate said rotor responsive to said pressurized fluid, said rotor is configured to rotate about an axis, and said at least two tangential jets are directed at an angle skewed from said axis.

44. The system of claim 30 wherein said housing includes a rotor rotatably mounted within said housing, said rotor defining passageways for providing fluid communication between said interior of said housing and at least two tangential jets oriented off center for generating torque to rotate said rotor responsive to said pressurized fluid, and said rotor further comprises a center jet interposed between said at least two tangential jets.

45. The system of claim 30 wherein the shoe is attached to tubing used to lower the shoe into the well casing.

46. The system of claim 30, wherein said spring comprises a square cross-section.

47. A system for facilitating lateral drilling through a perforation in a well casing, the system comprising:

a shoe positioned in the well casing, the shoe defining a passageway extending through the shoe from an upper opening in the shoe to a side opening in the shoe aligned with the perforation;

a hose having a first end and a second end, said first end of said hose being in fluid communication with a source of pressurized fluid;

an internally rotating nozzle having a housing in fluid communication with said second end of said hose, said housing having a rotor rotatably mounted within said housing, said rotor defining at least one jet and passageways for providing fluid communication between said interior of said housing and said at least one jet, said nozzle being positioned in the passageway of said shoe for ejecting fluid from said at least one jet through the perforation into subterranean formation material, said nozzle being configured for passing substantially horizontally through said perforation in the well casing and substantially laterally into a subterranean formation; and at least one spring circumscribing said hose and extending from said nozzle at said second end of said hose to said first end of said hose for facilitating pushing of said hose and said nozzle through said perforation of said well casing into a subterranean formation.

48. The system of claim 47, wherein said spring comprises a square cross-section.

* * * * *